United States Patent [19]

David

[11] Patent Number: 4,546,978

[45] Date of Patent: Oct. 15, 1985

[54] DICE AND GAMES

[76] Inventor: Constant V. David, 4952 Field St., San Diego, Calif. 92110

[21] Appl. No.: 625,739

[22] Filed: Jun. 28, 1984

[51] Int. Cl.[4] ..... A63F 9/04

[52] U.S. Cl. ..... 273/146

[58] Field of Search ..... 273/146, 161; 40/107

[56] References Cited

U.S. PATENT DOCUMENTS

| | | | |
|---|---|---|---|
| D. 142,576 | 10/1945 | Morris | 273/146 UX |
| 244,520 | 7/1881 | Bacon | 273/146 |
| 1,257,779 | 2/1918 | Anderson | 273/146 |
| 1,463,388 | 7/1923 | Cullen | 273/161 |
| 2,797,512 | 7/1957 | Sieve | 40/107 |
| 3,195,895 | 7/1965 | Kropinski | 273/146 X |
| 3,208,754 | 9/1965 | Sieve | 273/146 |
| 3,608,905 | 9/1971 | Edison | 273/146 |

FOREIGN PATENT DOCUMENTS

| | | | |
|---|---|---|---|
| 1064191 | 12/1953 | France | 273/146 |
| 1133997 | 11/1956 | France | 273/146 |
| 2268544 | 12/1975 | France | 273/146 |
| 2383685 | 11/1978 | France | 273/146 |
| 2437853 | 6/1980 | France | 273/146 |
| 2528320 | 12/1983 | France | 273/146 |
| 588253 | 5/1977 | Switzerland | 273/146 |
| 697160 | 9/1953 | United Kingdom | 273/146 |

*Primary Examiner*—Paul E. Shapiro

[57] ABSTRACT

Die configurations displaying six or more equal faces are provided. The die is constructed to provide a space volume inside an outer shell in which a ballast weight is positioned. Also provided is a die construction with manual and/or chance adjustment. The skill of the player is then influential in determining chance and examples of possible uses for games of chance indicate how the player can exercise such skill in challenging games in which chance can be altered in favor of the player throwing the die.

12 Claims, 23 Drawing Figures

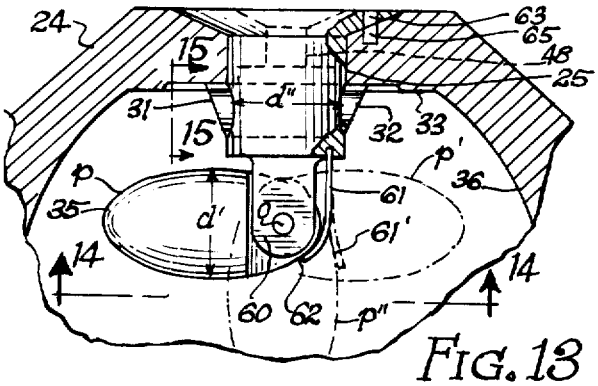
FIG. 13
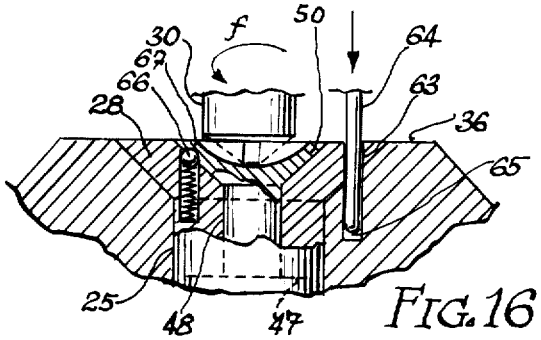
FIG. 16
FIG. 14
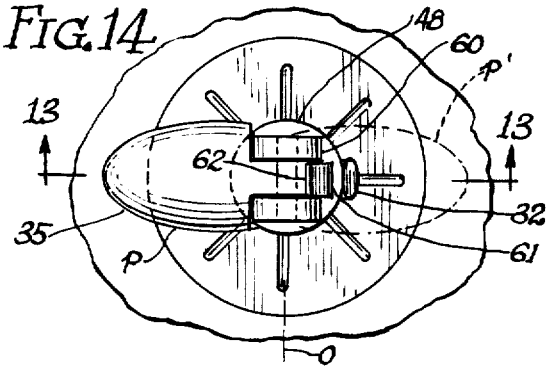
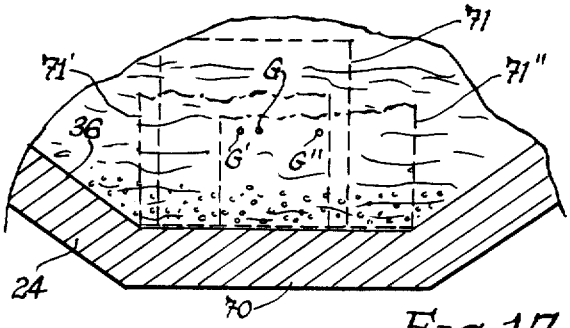
FIG. 17
FIG. 18
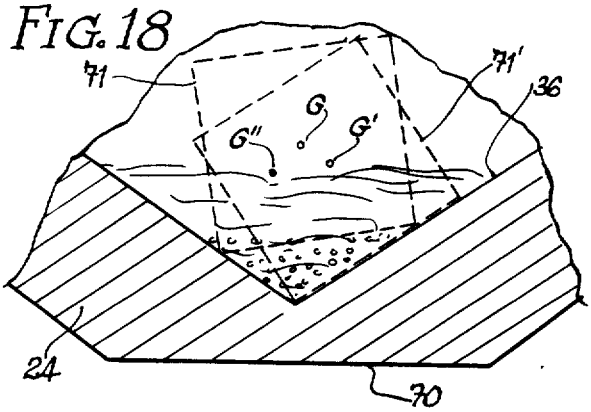
FIG. 19
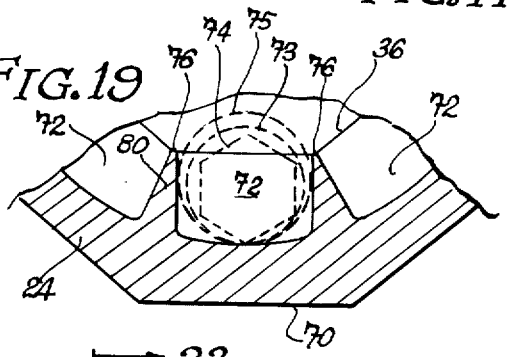
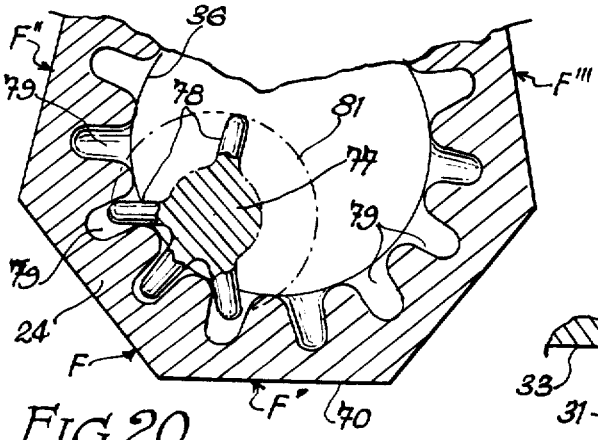
FIG. 20
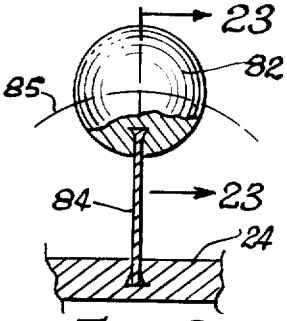
FIG. 22
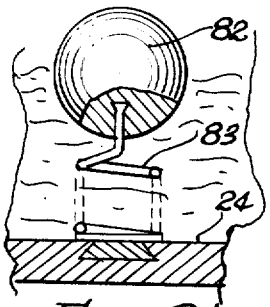
FIG. 21
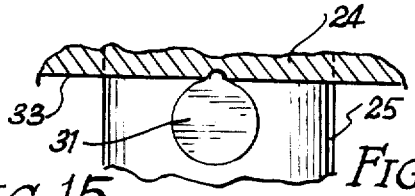
FIG. 15
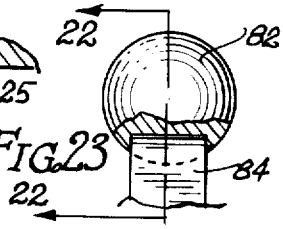
FIG. 23

DICE AND GAMES

BACKGROUND OF THE INVENTION

For almost all known history of mankind, records exist of man having played games of chance. Various methods and objects have been used to introduce a true element of chance into the generation of an equal probability of some physical indication (reading) to manifest itself, within a range of equally possible probabilities. Perhaps, the best and simplest object used to generate such chance reading is a cube made of homogeneous material, referred to as die, which is thrown on a flat surface. Theoritically and for all practical purpose, such a cube has an equal chance to come to rest on either one of its six faces. The upper face thus fully exposed displays an indicium which constitutes the reading symbol. If all faces exhibit a different kind of symbol, each of such symbol has an equal probability to show up on the displayed face of the cube. It is one out of six. The probability number would be lower if the number of faces were made larger for each die. By its essence, a single cube fixes and limits the number of readings to six (six faces).

Other shapes of solid bodies exhibiting a larger number of faces exist and could prove more attractive as chance generator by offering a higher number of possible "chances". However, they must all have the typical characteristics inherent to a cube: (1) have equal and flat faces, (2) these flat faces must occupy the whole external surface of the body, (3) it must easily roll and always come to rest on one face, if unhampered, (4) each one of its faces must be easily readable without ambiguity, and (5) each and every face must have the same probability to come to rest when the body rolls unhindered on a flat surface. Generally speaking, and using standard dice as a model, this means that: (1) opposite faces must be parallel, (2) the angles made by the planes of any and all contiguous faces must be equal, (3) the perpendicular from the die center of gravity to each face must pass through that face center, (4) all faces have equal areas and identical shapes, and (5) all faces are adjacent to other faces along all of their periphery. A cube made of homogeneous material fulfills all of these conditions. These conditions are also fulfilled by two other regular polyhedra. There is only a total of 4 regular polyhedra in addition to the cube. The table below identifies them.

| Name | Number of Faces | Face Shape |
|---|---|---|
| Tetrahedron | 4 | Triangular |
| CUBE | six | SQUARE |
| Octahedron | 8 | Triangular |
| Dodecahedron | 12 | Pentagonal |
| Isocahedron | 20 | Triangular |

The tetrahedron has a pyramidal shape and does not qualify. The octahedron does not fulfill all of the conditions listed above and would offer little advantage over the cube. Only two regular geometric solid bodies are left and offer great possibilities: the dodecahedron and the isocahedron.

The dodecahedron, with twelve pentagonally shaped faces, is very attractive for use as a die, from all standpoints. It fulfills all conditions ideally and its faces are optimally shaped as compared to those of the isocahedron. The latter has twenty identical triangular faces. The number of its faces is larger than that of the dodecahedron, but a triangle is not ideally shaped to display a symbol.

SUMMARY OF THE INVENTION

Accordingly, it is a primary object of the present invention to provide a new dice configuration that greatly increases the number of even chances per throw, for each die.

It is another object of the present invention to provide a combination of two dice that permits to generate, in one throw, a total number of chances that is higher than the number of days and holidays contained in a calendar year.

It is another object of the present invention to provide a combination of two dice that permits to generate, in one throw, a total number of chances larger than one thousand.

It is another object of the present invention to provide a new game based on the probability to obtain any calendar dates and holiday dates by one throw of two dice.

It is another object of the present invention to provide means for changing and adjusting the chance characteristic of all faces of dice to simulate the results given by loaded dice.

It is still another object of the present invention to provide means for developing new games based on the use of dice which yield combinations of unequal chances that can be modified and adjusted by the players as means for betting.

DESCRIPTION OF THE DRAWINGS

FIG. 13 is a detailed partial midsectional elevation view of the removable ballast trim mechanism shown in FIG. 5 and taken along section line 13—13 of FIG. 14.

FIG. 14 is a bottom view of the removable ballast trim mechanism shown in FIG. 13, seen from section line 14—14.

FIG. 15 is a partial sectional view taken along section line 15—15 of FIG. 13.

FIG. 16 is a detailed partial midsectional elevation view of the locking mechanism of the ballast trim removal arrangement shown in FIG. 13.

FIG. 17 is a partial schematic diagram showing the various positions that a cube can assume in a typical hollow polyhedronally-shaped shell.

FIG. 18 is a partial schematic diagram showing the various positions that a cube can assume in another typical hollow polyhedronally-shaped shell.

FIG. 19 is a partial schematic diagram showing the manner in which a mobile ballast weight can be made to fit into cells distributed evenly around the internal surface of a polyhedronally-shaped shell.

FIG. 20 is a partial schematic diagram showing how a specially shaped mobile ballast weight can be caused to mesh with the specially shaped internal surface of a polyhedronally-shaped shell.

FIG. 21 is a partial midsectional elevation view of a ballast weight shown supported by a coil spring.

FIG. 22 is a partial midsectional elevation view of a ballast weight shown supported by a leaf spring and taken along section line 22—22 of FIG. 23.

FIG. 23 is a partial midsectional side view of the ballast weight arrangement of FIG. 22 taken along section line 23—23 of FIG. 22.

DETAILED DESCRIPTION OF THE INVENTION

Figures 1, 2, 3, 4, 5, 6, 7, 8, 9, 10, 11, 12:
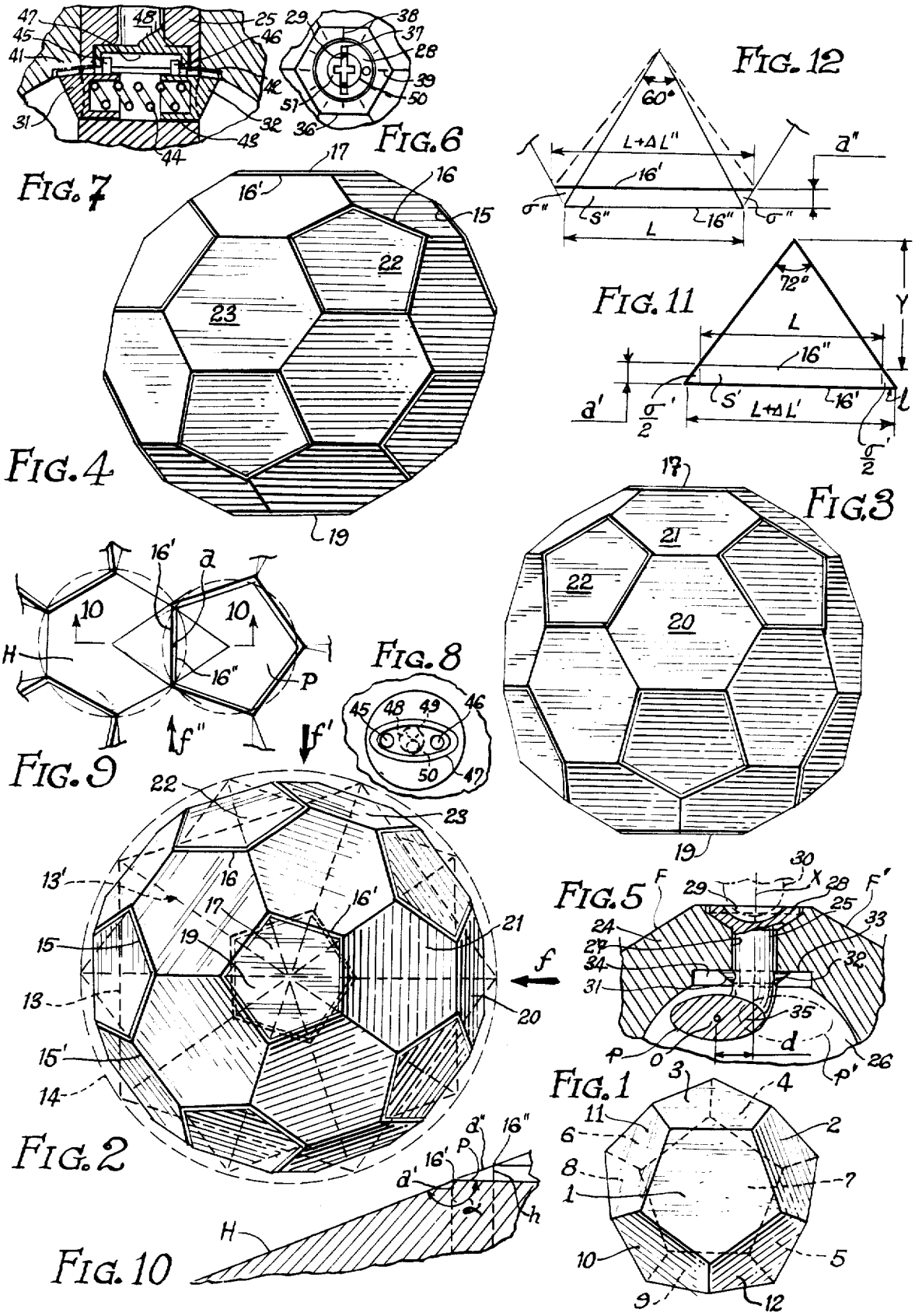
FIG. 1 is a top view of a regular dodecahedron.
FIG. 2 is a top view of a truncated regular isocahedron.
FIG. 3 is an elevation view of the truncated regular isocahedron shown in FIG. 2.
FIG. 4 is a side view of the truncated regular isocahedron shown in FIG. 2.
FIG. 5 is a partial midsectional elevation view of the ballast trim adjusting mechanism.
FIG. 6 is a top view of the ballast trim adjusting dial.
FIG. 7 is a detailed partial midsectional elevation view of the locking device of the ballast trim adjusting mechanism.
FIG. 8 is an end view of the actuating mechanism of the ballast trim locking mechanism.
FIG. 9 is a diagram showing the effect of the truncation process on two contiguous faces of an isocahedron.
FIG. 10 is a diagram showing the influence of the angle between the planes of two contiguous faces on the results of the truncation process.
FIG. 11 is a diagram showing the relationship between the side and the area variations of a segment of a pentagonal face as a result of the truncation process.
FIG. 12 is a diagram showing the relationship between the side and the area variations of a segment of a hexagonal face as a result of the truncation process.

Referring to FIG. 1, a regular solid geometric body is shown, called dodecahedron (12 identical pentagon-shaped faces). Each face, referred to as 1 to 12, lies in a plane parallel to the plane in which the opposite face lies, an opposite face being that which is quasi-symmetrically opposed with respect to the center of the dodecahedron. The following faces 1, 2, 3, 4, 5 and 6 are respectively opposed to faces 7, 8, 9, 10, 11 and 12. As an example, when face 7 lies down on a horizontal flat surface, face 1 is displayed to an observer looking down onto that surface (plane of the drawing). Each face can be colored and/or display a marking or indicium which consist of an easily recognizable symbol such as a number, a letter, a figure, etc. . . . The regular dodecahedron shown in FIG. 1 can therefore be used instead of a die that conventionally and usually has six faces (cube). The appellation die (and dice) is used hereafter when the body is used as a conventional die would be. The number of faces of the dodecahedron being 12, whence its name, if it is made of homogeneous material and thrown onto a flat surface, there is an even chance (one out of twelve) that it will land and/or come to rest on any given face (1/12 probability or 12 combinations of equal chance). The number of combinations is thus twice the number of combinations offered by a cube, or the probability is half that yielded by a cube.

FIG. 2 illustrates the possibilities offered by the next regular solid geometric body: the isocahedron. Such a polyhedron (the regular polyhedron with the maximum possible numbers of faces) is shown in dotted lines such as 13 and 13', inscribed in a sphere represented by phantom line 14. The isocahedron is bounded by 20 equal equilateral triangles, with five of such triangles forming twelve apexes between themselves. All such apexes are equally distributed on and throughout spherical surface 14. Each triangular face can be used as the face of a die. All surfaces can also bear different indicia as described in the case of the dodecahedron, offering thereby the possibility of twenty even chances (1/20 probability or 20 combinations). However, FIG. 2 shows a much more promising way of exploit the possibilities of the isocahedron, by truncating each and every one of the twelve apexes identically. The solid quasi-regular body thus formed has thirty two faces comprising twelve regular pentagons and twenty regular hexagons, shown in thin solid lines such as 15 and 15', if the truncation is performed as follows: (1) all sides of the pyramids removed by the truncation process are equal, and (2) the amount of truncation is such that the triangular faces of the isocahedron are all reduced by exactly half their initial area to form regular hexagons. A new die shape is thus created. However, although the areas of all of the hexagons and those of all of the pentagons are equal for each type of the polygons thus obtained, the areas of the hexagons are larger than those of the pentagons, because they both share sides of equal length L, in which case the area of the hexagon is 2.598 $L^2$ and the area of the pentagon is 1.721 $L^2$ (ratio of 1.5096). The area of such pentagon is then approximately $\frac{2}{3}$ of that of one hexagon, therefore the chance of such a die landing or coming to rest on a pentagon is approximately 1/42 and 1/28 in the case of a hexagon. To make it an even chance for both pentagons and hexagons (1/32), the regular pentagons must be made larger and the hexagons smaller. Increasing the degree of truncation does just that. The pentagons remain regular in shape, whereas the hexagons lose their "regular" characteristic, but still remain symmetrically shaped with respect to three principal axes of symmetry and are referred to as quasi-regular hexagons. This new quasi-regular solid geometric body just described thus evolves into another quasi-regular solid geometric body for which all faces can easily be made equal and which is represented by the thick solid lines such as 16 and 16' of FIG. 2. In a fashion, the latter configuration qualifies even more aptly for the quasi-regular appellation.

Again, each and every one of the 32 faces of this new quasi-regular geometric body or polyhedron can be identified uniquely and singularly by an indicium easily recognizable. Again, each and every one of the 32 faces is parallel to its opposite. This new polyhedron can be used as a die yielding 32 even chances each and every time it is thrown and comes to rest flat on one of its 32 faces. FIGS. 3 and 4 show how both versions of this new dice configurations appear when the die shown in FIG. 2 is viewed from the directions of arrows f and f' respectively. For ease of representation and understanding, the pictorial convention rule of thin and thick solid lines used in FIG. 2 is followed in FIGS. 3 and 4. The correspondence of faces and face sides between those three figures is indicated by lines 15, 16 and 16', faces 22 and 23 in FIGS. 2 and 4, by faces 20, 21 and 22 in FIGS. 2, 3 and 4, as examples. These can be used as guides to establish any further correspondence of faces between the die appearances when viewed from 3 orthogonal directions. Also, face 17, shown on top in FIGS. 3 and 4, is rotated 36° with respect to face 19, shown at the bottom in FIGS. 3 and 4, which explains the symmetry evident in FIG. 3, but which is lacking in FIG. 4. This is caused by the fact that directions shown by arrows f and f' are perpendicular, whereas the axes of planes of symmetry of the die are spaced 36° apart as is made obvious by FIG. 2. It should be pointed out at this point that this apparent lack of symmetry does not affect the die stability and/or the probability of its tilting one way or the other (FIG. 4) because, if the body is made of homogeneous material, the vertical line down from its center of gravity always passes through the center of each and every one of its faces that lies down horizontally. In other words, as is the case for a tumbling homogeneous cube, this new quasi-regular polyhedron is more prone to tumble around a side than over an apex, but with an equal probability, however, for all sides of the face on which it rests at any time.

Referring to FIG. 5, a partial section of a dodecahedron (or of any modified quasi-regular polyhedron) is shown, illustrating the manner in which the center of gravity of a die can be changed and/or adjusted. A stem 25 goes through wall 24 of a hollow polyhedron having a hollow core 26. Stem 25 is retained by a head 28 equipped with a groove 29 in which a tool bit 30 (shown in phantom line) can fit. Stem 25 is locked in place axially by two sliding pegs 31 and 32 against bottom face 33 of countersink 34. A mass 35 is affixed to the other end of stem 25. The center of gravity of mass 35, shown as point 0, may or may not be located on line X, which is the axis of rotation of stem 25. One or more faces of the polyhedron can be equipped with such a ballast trim.

FIGS. 6 and 7 show other details of such ballast trim. A typical face 36, viewed from the outside, displays head 28 of stem 25 depicted positioned at the null reference point. This null reference position is identified by index 37 on stem head 28 and shown facing null reference point 38 on face 36. Other indexes such as 39 indicate the varied positions that stem head 28 can be made to assume. Bottom face 33 of countersink 34 exhibits small radial indentations such as 41 and 42, positioned in line with indexes 39, so that pegs 31 and 32 can lock stem 25 into any position selected and which corresponds to index 37 being in front of any of indexes 39. Referring to FIG. 7, pegs 31 and 32 slide inside a transversal hole 43 of axis perpendicular to stem 25 axis. These pegs are pushed and held apart by compression spring 44 and retained by stops 45 and 46. An oblong-shaped cup 47 located inside stem 25 and actuated by axle 48, counteracts spring 44 force. The shape of cup 47, as shown in FIG. 8, is such that a 90° turn relatively to stem 25 forces stops 45 and 46 toward each other to an extent such that stops 45 and 46 become fully retracted and disengage stem 25 which thus become unlocked and can easily be extracted. Turning cup 47 back (or another 90°-turn in the same direction) relocks stem 25 in place, if so required. Referring back to FIG. 6, the head 50 affixed to axle 48, also equipped with a groove 51 (both shown in phantom lines), all contained within stem head 28, locks axle 48 longitudinally onto stem 25 body. This makes the assembly of cup 47, axle 48 and axle head 50 an integral part of stem 25. FIGS. 9–12 show geometric figures used in the next section for the explanations and discussion of the truncation process and of its amount.

FIGS. 13 to 16 show details of the ballast trim adjustment, illustrating how stem 25 and mass 35 can easily be removed through wall 24 and how the head of stem 25 can be locked in place while axle 48, that actuates release cup 47, is turned by tool bit 30 to retract locking pegs 31 and 32. Mass 35 is connected to stem 25 by articulation 60. Leaf spring 61 anchored in stem 25 at its bottom end pushes at point 62 on mass 35 located with respect to axis 0 of articulation 60 in a way such that mass 35 assumes position p (or p′ when stem head 28 is turned 180°). The diameter d′ of mass 35 is slightly smaller than diameter d″ of stem 25. When stem 25 is unlocked (pegs 31 and 32 retracted) and pulled out, mass 35 is then forced to assume position p″, pushing leaf spring 61 to position 61′. Stem head 28 has a small hole 62 that lines up with corresponding hole 65 in wall 24, when set at its reference position, so that a pin 64 can be dropped in both holes to lock and hold stem head 28 in place, when tool bit 30 is applied on axle head 50 to lock or unlock stem 25. To keep cup 47 always in the correct position, a detent ball-spring arrangement 66 is located inside stem head 28 and engages two holes located 90° apart, such as 67. To lock (or unlock) stem 25, tool bit 30 needs only be turned 90° in the direction of arrow f, from one angular position to the other, as shown in FIG. 16.

FIGS. 17 to 20 schematically illustrate a loose ballast weight shown located at the bottom of cavity wall 36, if that die wall 24 rests on an horizontal surface on die face 70. The ballast weights 71 of FIGS. 17 and 18 are shaped as cubes, but illustrated as squares. In FIG. 17, the cavity wall 36 is a regular polyhedron similar to that which represents the external surface of wall 24 and concentrically positioned relatively to the external polyhedron surface, so that their faces are all parallel. In FIG. 18, the apexes of the internal regular polyhedron are positioned to face the centers of the die faces. In FIG. 19, wall surface 36 is covered with identical open cells such as 72 (one cell per die face) that nests a ballast weight shaped as a sphere (73) or a regular polyhedron (74), both smaller than reference sphere 75 which represents the maximum size of the regular body that can fit into a cell. Cells 72 can be circularly shaped or have a polygonal shape such that walls 80, which separate these cells, all have sharp edges such as 76, to facilitate the dropping of ballast weight 74 into cell 72.

The configuration of cavity wall 36 shown in FIG. 20 is a variation of FIG. 19 arrangement. In this instance, ballast weight 77 is equipped with a plurality of spikes such as 78 shaped and dimensioned to fit snugly into cells such as 79 located on wall surface 36. The relative locations of both spikes 78 and cells 79 are such that ballast weight 77 can easily roll onto wall surface 36 in any direction as the die tumbles or as the die thrower shakes and/or positions the die in his hand. However, the rolling of the ballast weight inside cavity 36 is far from smooth when this happens and ballast weight 77 must somehow disengage its spikes 78 either fully or partly out of cells 79. To effect full engagement (or complete full disengagement), as the ballast weight rolls, its center must also move radially toward the die center, thereby generating "bumps" in the rolling motion of the ballast weight. This is achieved by properly shaping the surfaces of both spikes 78 and cells 79. For ease of illustration, in FIGS. 17 to 20, the internal views of the cavity wall surface 36 located behind the section planes are omitted for the sake of clarity. In the case of FIG. 20, phantom line 81 indicates the spherical contour within which the tips of spikes 78 are located.

FIGS. 21 to 23 illustrate a spherical ballast weight anchored to one end of a spring which, in turn, is anchored at at its other end into wall 24 of the die. The coil spring 83 shown in FIG. 21 permits ballast weight 82 to oscillate in all directions and, in the case of a properly designed spring, with an identical force/displacement characteristic. The leaf spring shown in FIGS. 22 and 23, however, permits only one type of oscillation of ballast weight 82: in the plane of symmetry of the spring, and which corresponds to the plane of FIG. 22; thus forcing the center of gravity of ballast weight 82 to follow the path indicated by phantom line 85. To further increase the number of possibilities offered by the mobile ballast weight configurations represented in FIGS. 17 to 23, the cavity bounded by the wall surface 36 can be partially or completely filled with a viscous fluid (not shown in the Figures), which can then influence both the motion of the ballast weight during the die motion and the ballast weight position when the die completes its tumbling. The viscosity of this fluid can also be made temperature dependent. The single solid ballast mass can also be replaced by high density particulates dispersed in that viscous fluid, although not shown in the drawings.

DISCUSSION AND OPERATION OF THE INVENTION

The operation of dice shaped as either regular dodecahedra or regular isocahedra is simple and straightforward. If both are made of homogeneous material, their faces are all symmetrical wih respect to the polyhedron center, and this center coincides with the center of gravity of the polyhedron. The probability that each and every one of such polyhedron faces has to come to rest on any given one of them, when such polyhedron lays flat on a horizontal surface, is then the same for all faces of any die configured as a regular or quasi-regular polyhedron as described and discussed herein.

An approach can be used to distribute the chance numbers of all the faces of a die around a mean value, even though the polyhedron shape of the die is regular of quasi-regular as earlier described (faces of equal areas). Usually, dice are homogeneously made, and any attempt to disturb such homogeneity, to deceive or cheat, called loading (loaded dice), is frowned upon by players and the Law alike. However, loading a die, if done with everybody's knowledge and acquiescence, according to established and verifiable rules, changes the chance number distribution that would otherwise characterize a given die configuration. Also, if the amount and location of the "load" can be changed, adjusted and programmed, a given die configuration can be used to yield a large number of chance number ranges and distribution schedules. Such a controlled and programmed loading is achieved with the mechanism shown in FIGS. 5, 6, 7 and 8. The die body consists of a shell externally shaped as a regular polyhedron or as a quasi-regular polyhedron. The inside of such shell is empty and a loading mechanism is secured on one face. More than one loading mechanisms can be used for each die configuration, with an equal number of faces being each equipped with such a similar loading mechanism. If more than one of such mechanisms is used for each die, they must be sized and arranged in a manner such that they do not interfere with one another as the load position is adjusted. The loading mechanism configuration shown in FIG. 5 fulfills such a requirement. A quick comparison of the size, location and shape of the load immediately indicates that at least two and possibly up to five such loads can rotate freely 360° around axis X, inside central cavity 26. During such a rotation, the contour of load 35 moves from one extreme left position p to the other extreme right position p'. If 0 is the location of the center of gravity of load (mass) 35 and d is the distance between 0 and the axis of rotation X, the center of gravity of the load can shift 2d from side to side in any and all directions around axis X. Load 35 is made of material of high density such as lead, and a shift of the load from p to p' obviously greatly increases the chance of face F' being the face on which the die comes to rest as compared to that of face F, which concomitantly decreases. In the case of a regular dodecahedron, each face is surrounded by at least five other contiguous faces. What is explained and discussed above regarding faces F and F' then applies to each one of such five faces. All of the other faces are also affected to a smaller degree. It is now easy to understand how the combinations of the various positions of 3 to 5 loading mechanisms located on faces distributed evenly around the surface of the regular polyhedron, can amply yield the chance number range and distribution previously discussed. Two additional parameters can also be introduced: (1) positioning the axis of rotation X off center with respect to the face center, and (2) orienting axis X at an angle with respect to the face plane that is different from 90°. A judicious combination of these two parameters for one loading mechanism is enough to provide the range and the distribution of chance numbers required. If only one load per die is used, the size of mass 35 relative to the size of inner cavity 26 of FIG. 5 is of course much larger and point 0 is much closer to the center of gravity of the shell, the distance d can also be larger. Especially in the case of a regular dodecahedron, one single heavy load and a judicious combination of the location and orientation of axis X suffices to provide a satisfactory range and distribution of chance numbers.

The position of the load must be referenced and indicated externally to the die. This can be done by means of an index such as 37 of FIG. 6 which corresponds to the location of point 0. The graduation 39 affixed on the die face serves to show where mass 35 is at any time. The die motion must not affect the location of the load inside the die. The loading mechanism is safely held onto the die shell by pegs 31 and 32 which also fall into indentations 41 and 42 cut into the shell inner wall. The reading given by the graduation number facing index 37 corresponds to a chance number assigned to each one of all the faces as established for that specific die configuration. If more than one loading mechanisms are used, the combination of more than one readings (one reading for each loading mechanism) must then be used to obtain the chance number distribution of all the faces. A table or booklet with multiple entries then provide information regarding the results of such combinations.

To change or remove a loading mechanism, the assembly of axle 48 and oblong cup 47 is used to pull in pegs 31 and 32. FIG. 8 indicates how the axial position of these pegs is controlled by rotating axle head 50 by means of slot 51, relatively to the loading mechanism body. A change of load configuration again affects both range and distribution of chance numbers, and again corresponds to another table, booklet and/or entry in such table and/or booklet. The numbers of possibilities thus created is very large indeed and further increases in the complexity of the die become cumbersome and self-defeating.

Both the types and amounts of the possibilities offered by the present invention are so numerous that attempting to list and summarize them is beyond the scope of the invention. Only a few typical examples of bases for games that can be devised in conjunction with the use of such dice need be described and discussed. Such games fall into two categories: (1) those using an even chance for deciding the move to be made by the player, and (2) those using uneven chances as the means for direct move decisions to be made according to the games rules and guidelines.

Providing that no intent and/or no element of cheating is involved in a game, and that all players are always equally aware of their chances at all times and understand the object of the game, there is no reason for the chances that characterize each face of a die to be equal. Two basic configurations of such dice were described earlier: (1) one has its faces asymmetrically located with respect to its center of gravity and of unequal areas, and (2) the other is a regular polyhedron, in which the center of gravity does not coincide with the polyhedron center, and which can even be made adjustable. Games based on the use of the first configuration can also be played using dice of the second configuration. But games can be conceived to be based on the use of the variable and adjustable chance feature of the dice belonging to the second configuration. In both cases, an educational aspect is automatically added to the other attributes of the games by showing and demonstrating the relationship between body shapes, center of gravity position and laws of probability. Two basic games are described below, as examples, one for each dice configuration. In both cases, the "points" won by each player at the end of each die throw can be either tallied to determine the amount of his winning (or loss), or used to establish his move (event) in a parallel combined game based on that specific usage of the dice. In the two game examples described below, it is assumed that the object of the game is for each player to only maximize the number of points won at the end of the game.

The first of such two typical games is based on the use of dice with fixed uneven chance distribution between all of the dice faces. In this example, two dice are used: a 12-face die and a 32-face die. The faces of the 12-face die exhibit a different color for each face, the faces of the 32-face die exhibit a different number (1 through 32) for each face. Any throw of these two dice thus results in a combination of one color and one number. Altogether, there are 384 such combinations. A proper chance number distribution for each dice can be established whereby each and every one of these combinations is characterized by one unique chance number, which results from combining each individual chance number for each face of each die. If the range of chance number per die corresponds to a ratio of 3/1 as an example between the highest and lowest chance numbers for each die, the overall range of chance numbers for the 384 combinations is 9/1. Theoritically, the distribution of these combination chance numbers can be made to vary by equal increments between two consecutive combination chance numbers, linearly between the lowest and the highest values. In fact, this is not possible for the practical reasons earlier discussed. However, the relative value of an increment between two consecutive combination chance numbers can easily be maintained within the 2 to 3% range, with 2.5% being the average for instance. A chart with 12 vertical entries (one column for each color) and 32 horizontal lines indicate the nominal chance number of that combination of face color and number in the space where the appropriate column and line intersect, for instance 1/1000. The two consecutive combination chance numbers (but not necessarily contiguously located on the chart) shown by the chart could be 1/998 and 1/1003, for instance. Whereas, the exact values might be respectively: 1/998.3, 1/1000.2 and 1/1002.9; which is really unimportant and practically irrelevant. This lack of exactitude is the first factor introduced in the game, which is left to chance and unknown to the players. For instance, for ease of understanding and handling by the players, the combination chance number chart has all chance numbers expressed as 1/X, X being a whole number between 140 (highest combination chance number) and 1200 (lowest combination chance number). This chart is given for reference and is used in an intermediary step for the computation of the number of points earned by the players. Nine additional charts are used to determine the point value given to each combination of color and face number. A number of points to be added to or maybe subtracted from the player's total number of points already reached at that time, is indicated in each space of each chart where color columns and face number lines intersect. All of these 9 charts differ from each other. They are numbered from 1 to 9. After a dice throw, the player reads the number displayed by the 32-face die and uses that number in two successive operational steps: (1) to determine the line he enters to read the combination chance number and the number of points to be credited to him for that throw, and (2) to find out which point chart he is supposed to use for reading the final number of points that he may receive. Step (2) is handled as follows, assuming that the face number drawn is 29 (as an example): $2+9=11$ and $1+1=2$, the point chart to be used in that case is #2. In other words, the face number digits are added until a final one-digit number between 1 and 9 is obtained. This final number is the number of the point chart to consult. Two numbers are indicated in each of the spaces of that point chart: (1) the number of points that the player is allocated, and (2) the theoritical combination chance number that corresponds to the number of points just allocated to the player. The player than compares this theoritical combination chance number to the nominal combination chance number indicated by the combination chance number chart for that dice throw. Because all the point values indicated in the point charts systematically and randomly differ from those which theoritically should be indicated is there were any logical correspondence between the two types of charts, the theoritical combination chance number given to the player by the point chart is always different from the nominal combination chance number. The former is either larger or smaller than the latter. If it is larger, the player gets his allocated points and adds them to this total already secured and it is the next player's turn. However, if the former is less than the latter, the player must choose one of 3 alternatives: (1) give up his allocated points, (2) contribute to the pool and throw one die of his choosing, or (3) contribute more to the pool and throw both dice. Now, the number of points yielded by this second throw, processed in the same manner as the first throw, is either equal (very unlikely), smaller or greater than the first number of points that were already allocated but not credited. If the two numbers of such points are the same, the player has won the pool and it is the end of that game. If the second number of points allocated is larger than the first, he is credited the second number of points. However, if the second number of points allocated is less than the first number drawn, he must deduct that second number of points from his total. The player is therefore often faced with very complex and important decisions. It is practically impossible for anyone to ascertain the odds of any decision exactly, although many players may try. This feature, which makes greed conflict directly with caution and requires a uncanny feel for trading, game understanding and risk/return evaluation, is the key attraction of this game because the relationships between the probabilities between risk and return are, on one hand, mathematically and exactly well defined, but, on the other hand, utterly left to chance. The first player to reach the ceiling established at the outset of the game by a concensus of the majority of the players, expressed in a number of points, wins the pool. The pool is built up, as time goes, with the contributions from the players, so much per die throw and double for a second throw of a player on his turn to play. Any player can quit any game at any time during that game, but he then loses his contributed pool share, and must still contribute a penalty calculated and/or specified by the game rules and/or the players at the start of that game. If all players but one quit before the ceiling is reached, the last player left, who obviously then has to his credit the highest number of points, wins the pool. Other reward and/or penalty arrangements can be set up by the players, or used to determine the players' moves in a related parallel game then used to decide who actually wins, and how much.

The second of such two typical games based on the use of uneven chance distribution makes use of two hollow dice shaped externally, one as a regular dodecahedron, the other as a QRTI. Each die has at least one face equipped with an adjustable and/or changeable ballast trim (load) as described and discussed earlier. Such dice can be used exactly, for any fixed setting of the adjustment, like the dice with fixed uneven chance distribution are used in the first game just described. The chance distribution setting is adjusted for each die prior to starting a game and kept the same throughout that game. A greater number of charts is then needed, one set for each combination of dice adjustment settings. Another version of games played with such adjustable chance dice, and which cannot be played with fixed uneven chance distribution dice, is described below as a typical example of such use.

In this instance, the adjustment of the chance number distribution for each die and each dice throw is set by the player whose turn either precedes or follows the present player, whose turn it is now to throw the dice. This present player selects which of these two other players he wants to do the adjusting, or which one adjusts which die if he so elects to do so, if 3 or more players are involved. If two players are involved in adjusting the dice (one player per die), according to the selection made by the present player, he may choose to allow them to consult with one another or forbid it, depending upon the odds the present player gives the other two players to be able to outwit him if working together or independently, whichever case might yield the worst decision to be made later by these two players. If only two players are playing the game, they can decide at the start of that game how and by whom the dice adjustments are to be performed and set. Now, regardless of the number of players, after the adjustments are made, the present player throws both dice. The results of that throw are read and recorded. Then the present player and the die "adjuster(s)" bet on the number of points that this throw may credit the present player, before the point chart is consulted. The bet pertains to whether that credit amount will be more or less than the mean of all possible numbers of points that can be obtained from one dice throw. If the present player's guess is correct, he is credited with the number of points allocated to him from the point chart indication. If the other player(s)' guess is also correct (same as that made by the present player), the other player(s) lose and gain nothing. However, if the other player(s)' bet is wrong, the amount of points credited to the present player is taken away from the player(s), half and half as the case may be. If the present player's guess turns out incorrect, he loses the amount of points that the point chart indicated, if the other player(s) are right in their bet. However, should the player(s) also turn out to be wrong, nobody loses or gains any point, it is a standstill and all the players vote as to whether the present player is allowed to try again or the turn to play goes to the player next in line to play. The betting decision between the 2 players (if 3 or more players) who did the dice adjusting is made in secret without the knowledge of any of the other players. When the present player and the other player(s) compare their bets, neither party knows the decision reached by the other. The players play in the order that they decided on at the start of the game throughout that game. A point ceiling is also selected then. Nobody can quit during any game. The first player to reach that point ceiling wins the game and takes the pool. Each player whose turn it is to throw the dice, at any time during the game, must contribute a quota to the pool. This quota consists of two parts, one which is mandatory and the other, of equal amount, which is elective. If a player elects to contribute the second half of that quota, he receives extra points for it and these are added to the points already credited to him. The players decide at the start of a game on the amount of the quota and on the amount of points that half a quota will "buy" during that game. During the beginning portion of a game, for the sake of simplicity, a player cannot be penalized for more points than he already has to his credit. In games played by more advanced players, however, in such an instance, it can be agreed that a player can show a deficit (negative number of points). Many such possibilities can be added to the game, depending upon the degree of sophistication of the players.

In a modified version of the last game, the point chart numbers can be used to determine the load adjustment setting of the two dice, instead of leaving that decision to one or two other players. The next player then must throw the dice thus set. However, that player may, if he so chooses, adjust the dice to setting(s) of his own choosing if he contributes an extra penalty to the pool. Then, the betting that took place between the present player and the "die adjuster(s)" in the preceding version of this game can also take place here, but between the present player and any other player(s) in the game who wishes to do so. In both versions of the last game, a player endowed with a computer-like mind who could memorize all possible combinations of probabilities and chart data, and who could process such information quickly enough, for each of his dice throws, could "beat" the system and, given enough throws, always win. Very few players, if any ever, can ever reach that stage. Then, the point arrangements on the point charts could be changed and/or scrambled up so that such a player would have to memorize a new set of point charts again. However, this feature is the strongest enticing challenge presented by such a game: hoping to become a better player through knowledge and by being able to apply fast thinking consistently for long periods of time in a stretch.

For the dice configurations and their associated games discussed so far, the manual skill of the dice thrower is not relevant, regardless of whatever players betting on pure chance occurences may think. However, whenever the probability of a die coming to rest on a preselected face (the opposite face thus providing the "die reading") can be influenced and selectively altered by the way in which the die is thrown and made to tumble, the skill of the die thrower can then affect his chances of "winning" appreciably, after a series of consecutive throws. Providing all the competing players have an equal opportunity to know the relevant facts and to exercize their skill, no player is given an undue advantage over the others. This possibility is offered by the hollow die configurations shown in FIGS. 17 to 23, wherein the ballast weight is mobile and is thus able to directly affect the temporal position of the die center of gravity in a way such that any face of the die can be made to offer a chance higher than that of the average chance given by all faces, and thus even much higher than that which characterizes its opposite face. In the die configurations shown in FIGS. 17 and 18, this is achieved by giving a cube having an edge length equal to or shorter than the edge length of the internal polyhedronally-shaped cavity which contains that cube. Cube 71 can thus assume, when the die comes to rest, extreme positions shown by lines 71' and 71'', in FIG. 17, depending upon the motion imparted to the die by the player. Cube 71 center of gravity G can thus move from position G' to position G''. For the die configuration shown in FIG. 18, cube 71 can end tilted either toward the right or the left, or even askew (cube center of gravity in G). By tilting on its resting edge, cube 71 moves its center of gravity from position G' to position G'', which certainly affects the chance of that die to tilt right, rather than left, at the end of a tumble.

The combination of the fully mobile ballast weight shown in FIG. 19 with the cells cut in the wall 24 of the die shell offers another possibility of selectively positioning the ballast weight prior to the initiation of a throw and thereafter keeping the ballast weight located inside that cell during the die tumbling motion, if and when the die is thrown adequately. The fully mobile ballast weight configurations shown in FIGS. 17, 18 and 19 all have a much better chance to exhibit the characteristic feature just described if the die internal cavity is filled with viscous fluid. Such a fluid slows down the motion of the mobile ballast weight inside the cavity. To introduce another factor which can further affect the mobile ballast weight motion inside the cavity, and its final position toward the end of the die tumbling phase, the nature of the viscous fluid can be made such that its viscosity is appreciably affected by temperature in the 20°-35° C. range, so that the warmth of the players' hands can become an important factor in the outcome of the throw, depending upon the warmth of the player's hand (or breath). The nature of the viscous fluid can also be made such that its viscosity varies very little with temperature in the 15° to 40° C. range, thereby practically eliminating the influence of temperature on the die dynamic behavior during a throw.

In the case of the die configuration shown in FIG. 20, the internal motion of the mobile ballast weight is affected by a different type of interaction between the ballast weight and the die wall. A player can make the tightness with which the ballast weight 77 spikes fit in the cells of wall surface 36 vary by tapping the die against the heel of his hand prior to a throw. If the engaged spikes fit in snugly enough, and if the die is thrown properly, the die tumbling motion then may not dislodge the ballast weight and the die will behave like a heavily loaded die. In such a case, the probability of that die coming to rest on the selected face, if thrown by a skilled player, is much higher than the average, which is 1/n, where n is the total number of all identical faces of that die. One or more dice can be handled that way and thrown together, which require an even greater skill on the part of the player. Here again, a viscous fluid can be present inside the die, chosen either to be sensitive or insensitive to temperature. The viscous fluid then makes it more difficult for the player to throw the die without dislodging the ballast weight spikes.

Instead of letting the ballast weight move freely, some form of physical restraint can be applied on it by means of a spring attachment connecting the ballast mass to the die shell. The spring characteristics can be selected to allow the ballast weight either to move in any direction with equal ease or to move only in a preferential well-identified direction. Also, this preferential direction can be made adjustable from the outside of the die, by mounting one end of the spring on a rotatable arrangement similar to that shown in FIGS. 5, 6 and 7. In such an instance, the die cavity contains no fluid. In the spring attachment configurations shown in FIGS. 21 and 22, however, in which the spring angular position is not adjustable, the die internal cavity can also be filled with a viscous fluid. Its viscosity can be made dependent or independent on temperature, as previously discussed. Because either spring is very flexible, the oscillation frequency of the ballast weight is low and can be caused to be of a magnitude equal or close to the mean rate of tumbling of the die. When the die is thrown, if it is handled properly, a selected preferential position of the ballast weight inside the die can be imposed on it. If the die is then also caused to tumble at the correct rate, the ballast weight can be thus made to keep that selected position, until it comes to rest and displays the selected reading. This die configuration requires a considerable degree of skill to exploit, but it has the greatest potential for a very skilled player, in term of reliability. The player must always be aware that the face on which the die comes to rest is not the face that yields the reading, but that the reading is displayed by the face diametrically opposed to it. In other words, the reading is given by the face located the farthest from the die center of gravity.

All games outlined previously can also be played with such skill-oriented dice. However, two basic games founded on the combination of luck and manual skill are described below as examples. In the first game, each player in turn announces the die reading that he expects from his throw. Any other player(s) may also choose to bet. These players, however, can only select die readings that are different from that which the die thrower has selected. All players betting then pay an equal quota into the pool. The player who selected the correct reading, as evidenced at the end of that throw, is allocated a number of points. The other players, who lost, receive nothing at that time, but are given a chance to make their selection first later, when their turn comes to throw the dice. Except for the die thrower, other players have the choice of not betting if they feel that the die thrower is too skilled. When the amount in the pool reaches the ceiling chosen by the players at the start of that game, the game stops and the pool amount is then divided according to the number of points tallied by each one, although the distribution of the pool amount can also be done according to any other schedule agreed upon by the players at the start of a game. A skilled player can thus receive a share of the pool larger than the amount of the quotas he contributed during that game. The difference is his gain. An unskilled (especially if also unlucky) player receives an amount that could be considerably less than the amount he contributed. Again, the difference is his loss.

In a simpler and faster game version, the player contributes his quota only if and when he does not obtain the die reading that he selected prior to his throwing the die. If he is skilled enough (and lucky to boot), he will then contribute less often than chance alone would dictate. The pool contributions from the unskilled (and unlucky) players are correspondingly higher than chance, though. At the end of that game, a good player may have contributed appreciably less than the average of the other players. No record is needed of how many points each player has won during that game, however. At the end of the game, the pool is divided equally between all players. Again, at the start of the game, the players can decide to adopt a different schedule for the distribution of the funds. In both games, the sum total of all gains is equal to the sum total of all losses.

Although chance still plays an important role in such games in which skill (or the illusion of it) can be factored, it is of interest to examine the importance of both factors more closely. Depending upon the relative weight of the ballast mass as compared to the die overall weight, and the maximum displacement that the ballast weight is permitted inside the die cavity and/or the amount of restraint to which it is subjected, the ratio between the skill factor and the chance factor can be made to vary from almost $+n/3$ to $-n/3$ (case of a player so bad that his "skill" has actually a negative result, e.g. a player who confuses the die rest-face with the die reading-face), where n is agan the number of faces of the die. The denominator value "3" corresponds to a die with a very light and thin shell which contains a ballast made of very dense material (tungsten ball for instance). In a die configuration for which the ballast consists of tungsten particles dispersed in a small amount of viscous fluid, this denominator value could be less than 3. Another variable affects that denominator value, the shape of the die. As an example, in the case of a perfect sphere rolling on a perfectly flat and horizontal surface, the sphere always comes to rest on a point on its surface which lines up with its geometric center and its center of gravity. A sphere is a regular polyhedron that has an infinite number of faces ($n=\infty$). A quasiregular truncated isocahedron (QRTI) with 32 faces thus behaves more like a sphere than does a regular dodecahedron which has only 12 faces. For that reason, a minimum value for the denominator is more like 1.5 for a QRTI and between 2 and 3 for a regular dodecahedron (2.5 for instance). The ratio of the skill factor to the chance factor thus could be as high as almost 5 for a regular dodecahedron and approximately 20 for a QRTI potentially. Therefore, the influence of skill on the behavior of such dice can, theoritically, be made quite high and make games based on their use very challenging indeed.

In the case of dice and configurations in which a viscous fluid is used to affect the response of the ballast weight to the motion of the die, such dice must be manipulated by the player before the die is thrown. If the ballast weight is spring supported, the viscous fluid slows down the movements of the ballast weight inside the die cavity which should then be almost full of fluid, which decreases the ratio of skill factor to chance factor. If the ballast is in the form of particles, only a smaller amount of viscous fluid is needed, and the shape then assumed by the ballast weight is molded by the internal surface of die cavity. But the fluid viscosity acquires an even greater importance. The influence of the die temperature on the viscosity of the fluid introduces another degree of complexity, and of flexibility also, in the handling of the die prior to throwing.

The difference in the type of response of spring-supported ballast weights to hand manipulations and to die tumbling movements, between the configurations shown in FIG. 21 and FIGS. 22–23 should be further emphasized. The ballast weight shown in FIG. 21 is only prevented from rolling or tumbling on the cavity wall surface by its support spring. The ballast weight illustrated in FIGS. 22 and 23 is prevented from moving in any manner except along a well-defined planar path. The angular position of that path plane with respect to both the plane in which the die is manipulated and the plane in which the die is made to tumble is of paramount influence. This last die configuration certainly calls for the highest degree of skill.

The present invention opens up a new field in game playing based on chance. The few games succinctly described herein as examples demonstrates how wide and varied this field can be. The nature and operation of these new types of dice are such that they all have an educational aspect and lend themselves to even more educationally oriented fun games for children and adults alike. Extreme complexity can be built in these games and make them either completely chance dependent or highly logical and mathematically oriented games. The ratio of importance between these two extreme features can be adjusted to vary gradually throughout the full range of possibilities between these two extremes. To be good, a game should be challenging, entertaining, educational and never boring, but above all must offer the possibility for the players to develop some mental, psychological and/or intellectual skills. These new dice, and the games based on the use thereof, exhibit such characteristics and attributes. Any one of the game examples described herein, far from being limitative in nature, types, numbers and scopes, illustrates how each game example can easily be expanded, made more complex and more challenging, as the skill of the players improves, while the levels of the knowledge and of the understanding of the players increase in breadth and in depth.

Having thus described my invention I claim:

1. A die comprising:

a geometric body having a plurality of flat external faces and an internal cavity;

indicia on the faces;

a weight inside of the cavity; and means visible externally of the body for indexing the location of the weight inside the cavity to thereby vary the center of gravity of the die.

2. A die according to claim 1 and further comprising:

means for permitting the weight to be extracted from the body.

3. A die comprising:

a hollow geometric body having a plurality of flat faces;

indicia on the faces;

a ballast weight normally freely movable inside the body; and means for constraining the movement of the ballast weight inside the body so that when the die is thrown on a flat surface the probability of the die coming to rest with a given one of the faces in an indicating position will vary from throw to throw, including a quantity of fluid inside the geometric body having a viscosity which is substantially constant during variations in the temperature between about 15 degrees C. and 40 degrees C.

4. A die comprising:

a hollow geometric body having a plurality of flat faces;

indicia on the faces;

a ballast weight normally freely movable inside the body; and means for constraining the movement of the ballast weight inside the body so that when the die is thrown on a flat surface the probability of the die coming to rest with a given one of the faces in an indicating position will vary from throw to throw, including a quantity of fluid inside the geometric body having a viscosity which changes substantially during variations in temperature between about 20 degrees C. and 35 degrees C.

5. A die comprising:

a hollow geometric body having a plurality of flat faces;

indicia of the faces;

a ballast weight normally freely movable inside the body; and means for constraining the movement of the ballast weight inside the body so that when the die is thrown on a flat surface the probability of the die coming to rest with a given one of the faces in an indicating position will vary from throw to throw, including a spring connecting the ballast weight and the geometric body.

6. A die according to claim 5 wherein the spring is of the coil type.

7. A die according to claim 5 wherein the spring is of the leaf type so that the ballast weight can preferentially oscillate in a plane.

8. A die according to claim 7 wherein the constraining means further includes rotatable mounting means for connecting one end of the leaf spring to the geometric body.

9. A die according to claim 5 wherein the constraining means further includes a quantity of fluid inside the geometric body.

10. A die comprising:

a hollow geometric body having a plurality of flat faces;

indicia on the faces;

a ballast weight normally freely movable inside the body; and means for constraining the movement of the ballast weight inside the body so that when the die is thrown on a flat surface the probability of the die coming to rest with a given one of the faces in an indicating position will vary from throw to throw, including a quantity of a viscous fluid within the geometric body and a quantity of high density particles dispersed in the fluid.

11. A die according to claim 10 wherein the fluid has a viscosity which is substantially constant during variations in temperature between about 15 degrees C. and 40 degrees C.

12. A die according to claim 10 wherein the fluid has a viscosity which changes substantially during variations in temperature between about 20 degrees C. and 35 degrees C.

* * * * *